United States Patent [19]

Farace

[11] 4,215,635

[45] Aug. 5, 1980

[54] SAFE AND ARMING DEVICE

[75] Inventor: Louis P. Farace, Pennsauken, N.J.

[73] Assignee: The United States of America as represented by the Secretary of the Army, Washington, D.C.

[21] Appl. No.: 969,595

[22] Filed: Dec. 14, 1978

[51] Int. Cl.[2] ..... F42C 15/22

[52] U.S. Cl. ..... 102/238; 102/244; 102/255

[58] Field of Search ..... 102/238, 244, 232, 245, 102/255, 276

[56] References Cited

U.S. PATENT DOCUMENTS

| | | | |
|---|---|---|---|
| 2,448,228 | 8/1948 | McCaslin et al. | 102/238 |
| 2,457,254 | 12/1948 | McCaslin et al. | 102/238 |
| 3,670,655 | 6/1972 | Krupa | 102/238 |
| 3,972,290 | 8/1976 | Czajkowski et al. | 102/238 |

FOREIGN PATENT DOCUMENTS

| | | | |
|---|---|---|---|
| 2007358 | 9/1971 | Fed. Rep. of Germany | 102/238 |
| 1022437 | 3/1966 | United Kingdom | 102/238 |

*Primary Examiner*—David H. Brown
*Attorney, Agent, or Firm*—Nathan Edelberg; Robert P. Gibson; Max Yarmovsky

[57] ABSTRACT

An improved safe and arming device for isolating the fuse from the main explosive charge in spin stabilized shells to prevent premature detonation of such shells. The improved safe and arming device comprises a housing adapted to be positioned intermediate of the fuse and the main explosive charge of such shells for rotation therewith about a shell spin axis when the shell is fired, a rotor mounted in the housing for rotation about a rotor axis, and a rotatable control member engageable with the rotor and being rotatable about an axis extending in the same direction as the rotor axis for controlling the rate of rotation of the rotor. The rotor is positionable in a desired start position and is adapted to rotate in response to rotation of the shell to an armed position to communicate a detonation signal from the fuse to the explosive charge. The rotatable control member carries an oscillatory member which is adapted to periodically move in one direction and then in a different direction in response to rotation of the rotatable control member so that the momentum of the oscillatory member is periodically changed. The rate of periodic change of momentum thus controls the rate of rotation of the rotatable control member, which in turn controls the rate of rotation of the rotor from the start position to the armed position.

18 Claims, 13 Drawing Figures

SAFE AND ARMING DEVICE

GOVERNMENTAL INTEREST

The invention described herein may be manufactured, used and licensed by or for the Government for governmental purposes without the payment to me of any royalty thereon.

BACKGROUND OF THE INVENTION

The present invention relates to safe and arming devices for explosive projectiles, and more particularly to safe and arming devices for spin stabilized projectiles in which the safe and arming device isolates the fuse from the main explosive charge of the projectile to prevent premature detonation of such projectile.

Generally, the function of a safe and arming device, as its name implies, is to insure and maintain a safe condition for the cannon shells or other types of explosive projectiles until it is desired that the shells be capable of being detonated, at which time the shells are armed. In other words, the safe and arming device serves to prevent premature detonation of the shell, generally, prior to and during loading of the shells into the cannon or other firing device and provides a meaningful safe separation distance, for protection of the launch crew, along the projectiles flight path subsequent to firing. For this purpose, the safe and arming device is placed between the fuse and the main explosive charge of the cannon shell or other type of explosive projectile, and serves to interrupt or prevent communication of a detonation signal from the fuse to the explosive charge. Only at such time that it is desired to be able to detonate the shell (such as for example, after it is fired) is the safe and arming device allowed to assume an armed position in which a detonation signal may be communicated from the fuse to the main explosive charge of the shell.

On spin stabilized projectiles, which rotate rapidly about the axis on the projectile upon firing, the safe and arming device generally comprises a mechanism which rotates into the armed position in response to the rotation of the shell. However, prior to 1950, safe and arming devices for mechanical time fuses used on spin stabilized cannon shells were only capable of providing enough time delay to insure that the cannon shell would not detonate within the gun tube. Thus, once the shell is fired, it could be immediately detonated upon impacting an object in the path of the shell, such as for example, tree branches, birds, etc. Such immediate detonation could in turn cause extensive damages and injury to the equipment personnel in the vicinity from which the shell was fired.

Consequently, a longer time delay was desired to allow the shell to travel a substantial distance from its firing point before it is capable of detonating. For example, safe and arming devices were developed which were capable of allowing the shell to travel over 200 feet before it was capable of detonating. However, such prior art safe and arming devices have used a plurality of small pinions and complicated gearing arrangements to provide such time delay to prevent premature detonation of the explosive projectile. Such gearing arrangements and especially the small pinions used therein, because of the necessity of maintaining tight tolerances, are quite expensive to manufacture and/or to assemble in the safe and arming housing.

SUMMARY OF THE INVENTION

These and other disadvantages of the prior art are overcome with the improved safe and arming device of the present invention for isolating the fuse from the main explosive charge in spin stabilized shells to prevent premature detonation of such shells. The improved safe and arming device of the present invention comprises a housing adapted to be positioned intermediate the fuse and the main explosive charge of such shells for rotation therewith about a shell spin axis, a rotor mounted in the housing for rotation about a rotor axis, and rotation control means for controlling the rate of rotation of the rotor. The rotor has detonation communication means for communicating a detonation signal from the fuse to the explosive charge only when the rotor is in its armed position. Further, the rotor is positionable in a desired start position displaced from the armed position and is adapted to rotate from the start position to the armed position in response to rotation of the shell. The rotation control means comprises a rotatable control member which is engageable with the rotor, the rate of rotation of the rotatable control member thus controlling the rate of rotation of the rotor.

According to one principle of the present invention, a delay member is carried by the rotatable control member and means are provided responsive to rotation of the rotatable control member for causing the delay member to follow a tortuous path which carries the delay member in and out of the plane of the circular path defined by rotation of the rotatable control member. The speed at which the delay member follows the tortuous path thereby controls the rate of rotation of the rotatable control member and thus the rate of rotation of the rotor from the start position to the armed position.

According to another principle of the present invention, an oscillatory member is carried by the rotatable control member for movement in two different directions and means are provided responsive to the rotation of the rotatable control member for causing the oscillatory member to periodically move in one of the two directions and then in the other of the two directions to thereby periodically change the momentum of said oscillatory member. The rate at which the momentum of said oscillatory member is periodically changed thereby controls the rate of rotation of the rotatable control member and thus the rate of rotation of the rotor.

Both of these principles are incorporated in the preferred embodiment of the present invention. More particularly, the oscillatory member carried by the rotatable control member is supported for rotational motion about an oscillation axis extending in a direction transverse to the direction of rotation of the rotatable control member. The oscillatory member carries a pair of pins extending oppositely from the oscillatory member in the same direction as the oscillation axis. These pins comprise the delay member according to the first principle of the present invention. The means for causing the delay member to follow a tortuous path, as well as the means for causing the oscillatory member to periodically oscillate, comprises a cooperating rack member having a plurality of teeth adapted to cooperate with the pins extending from the oscillatory member. As the oscillatory member is rotated by rotation of the rotation control member, the pins follow the contour of the teeth of the rack, and are caused to move in and out of the plane of the circle path defined by the teeth. This movement of the pins also causes the oscillatory member to rotate first in one direction about the oscillation axis and then in the opposite direction about the oscillation axis to control the rate of rotation of the rotatable control member.

These and other features and characteristics of the present invention will be apparent from the following detailed description in which reference is made to the enclosed drawings which illustrate a preferred embodiment of the present invention. cl BRIEF DESCRIPTION OF THE DRAWINGS FIG. 1 is a plan view, partly in section, of the improved safe and arming device of the present invention with the top cover and upper cylindrical housing section removed, showing the rotor in the start, unarmed position.

DETAILED DESCRIPTION OF THE INVENTION

Figure 1:
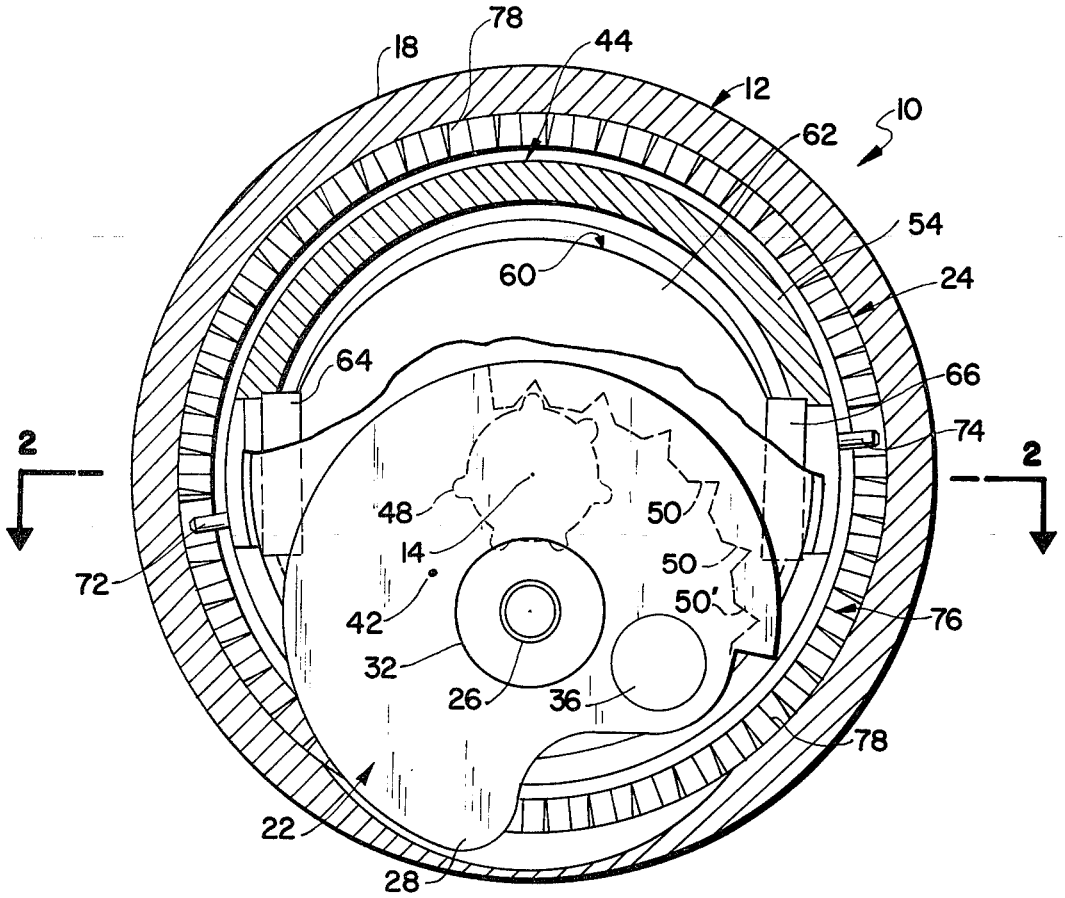
Figure 2:
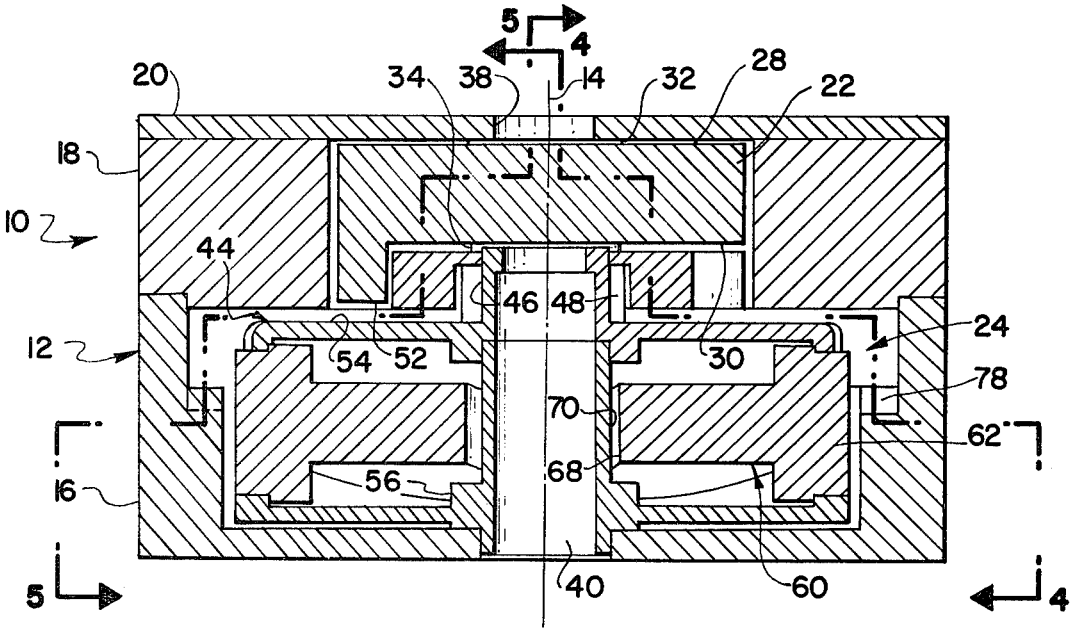
FIG. 2 is a side sectional view taken along lines 2—2 of FIG. 1 of the improved safe and arming device of the present invention.

Referring now to the drawings in which like reference characters represent like elements, there is shown in FIGS. 1 and 2 the safe and arming device 10 of the present invention. As is generally known in the art, the safe and arming device 10 is designed to be mounted between the fuse and the main explosive charge of the spin stabilized cannon shells or other types of explosive projectiles and serves to normally interrupt or block a detonation signal generated by the fuse from reaching and detonating the main explosive charge of the shell except when the safe and arming device 10 is "armed," i.e., in a position to transmit the detonation signal.

Generally, the safe and arming device is mounted to the base of the fuse which is in turn mounted in the shell casing for the spin stabilized shell or projectile. Upon firing or dicharge of the shell from the cannon or rifle, the shell is caused to spin rapidly about its central, spin axis. As a result of this rapid rotation, and as more fully described hereinbelow, the safe and arming device 10 is caused to be "armed" so that the fuse may be capable of detonating the main explosive charge of the shell. The fuse may comprise any well known fuse used for the purpose of detonating an explosive charge. For example, the fuse may comprise a firing pin which upon impact of a shell is caused to strike a percussion cap in the body of the shell to detonate the main explosive charge of the shell. Alternatively, the fuse may itself by comprised of a suitable explosive material which when detonated, such as upon impact or after a certain period of time following firing (if the fuse is a time fuse), sets up an explosive chain reaction, as through an explosive flash path, to detonate the main charge of explosive contained in the body of the shell.

As shown in FIGS. 1 and 2, the safe and arming device 10 includes a housing or module 12 which is of generally cylindrical shape and in which the various parts and components of the device 10 are encased. The housing or module 12 is adapted to be inserted in the bottom of a fuse, such that the housing center line 14 coincides with the fuse center line which also is the spin axis of the explosive shell or projectile. As best seen in FIG. 2, the housing is comprised generally of three components to facilitate assembly of the various components—a lower hollowed out cylindrical section 16, an upper hollowed out cylindrical section 18 and a cylindrical cover 20.

FIG. 1 is a plan or top view of the device 10 with the cover 20 and the upper hollowed out section 18 of the housing 12 removed to display a centrifugal rotor 22 and a rotation control mechanism 24 for controlling the rotation of the rotor 22 within the housing 12. The rotor 22 is the component which serves to interrupt detonation communication between the fuse and the explosive charge except when the rotor 22 is in an "armed" position.

The rotor 22, as best seen in FIG. 1, is of a generally nonsymmetrical configuration so as to be capable of being subject to a centrifugal force upon rotation of the shell when the shell is fired. More particularly, in the ebmodiment shown, the rotor 22 is of a kidney shaped configuration although other configurations may be utilized, as generally understood in the art. The nonsymmetrical rotor 22 includes a rotor pivot shaft 26 fixed thereto and extending beyond the upper and lower surfaces 28, 30 to be journalled in appropriate bored holes 29, 31 in the upper housing section 18 and the cover 20 (see FIGS. 4 and 5). As seen in the Figures, the upper housing section 18 has been hollowed out sufficiently for the particular configuration of the rotor 22 so that the rotor 22 may freely rotate within the hollowed out area about the rotor pivot shaft 26. In addition, the rotor 22 includes hubs 32, 34 on its upper and lower surfaces 28, 30 about the pivot shaft 26 which may comprise or be machined so as to provide a generally smooth sliding frictionless surface to allow generally frictionless rotation of the rotor 22 within the housing 12 and in particular between the upper housing section 18 and the cover 20.

Figure 3:
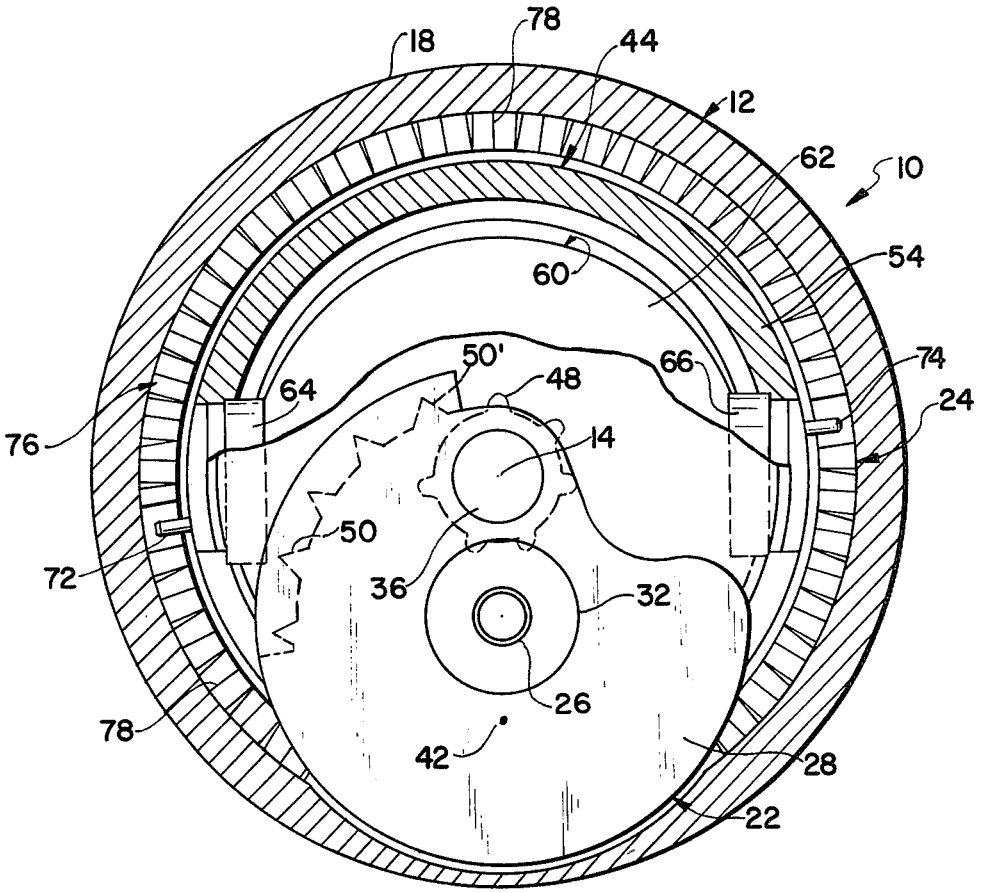
FIG. 3 is a plan view, similar to FIG. 1, except with the rotor rotated to the armed position.

The rotor 22 also includes a detonation communication means 36 which is arranged such that when the rotor 22 has rotated to an armed position the detonation communication means 36 is aligned with the central axis 14 of the housing 12 (see FIG. 3). Corresponding detonation communication means 38, 40 are provided in the housing cover 20 and through the rotation control means in the lower housing section 16, to be decsribed more fully hereinbelow, so that when the rotor 22 has rotated to its armed position, a continuous detonation communication path is set up through the housing 12 from the upper surface thereof to the bottom surface. In the preferred embodiment, the detonation communication means of the rotor 22 comprises a rotor detonation device 36 which is capable of being detonated by the fuse when the rotor detonator 36 is aligned with the central axis 14 of the housing 12 and the detonation communication means of the lower housing section 16 comprises an on-center detonator 40 which is capable of being detonated by the rotor detonator 36. Thus, in essence, an explosive or detonation chain is set up along the central axis of the safe and arming device 10 when the rotor 22 has rotated to its armed position. Alternatively however, the detonation communication means could simply comprise openings through the housing 12 to provide a firing pin path, a flash path, etc.

The rotor 22 is initially positioned within the upper housing section 18 so that the detonation communication means 36 is not aligned with the central axis 14 of the housing 12. The rotor thus serves as a detonation communication interrupter to prevent detonation communication between the fuse and the main explosive charge of the shell. This displaced start position is shown in FIG. 1.

The nonsymmetrical rotor 22 has a center of gravity, designated as 42, which is displaced from the rotor pivot 26 of the rotor 22 and also from the central axis 14 of the housing 12 which corresponds with the spin axis of the shell. Thus, upon firing of the shell or projectile which causes the shell to spin about the central spin axis, a centrifugal force or turning moment is exerted on the rotor 22 to cause it to rotate about its pivot shaft 26. As is well known, this centrifugal force is such as to cause the center of gravity 42 of the rotor 22 to assume a position which is farthest from the central spin axis 14. Once that position is achieved, rotation of the rotor 22 relative to the spin axis of the housing 12 ceases. Thus, referring to FIG. 1, it is seen that the center of gravity 42 of the rotor 22 is displaced to the left and between both the central spin axis 14 and the rotor spin shaft 26. Therefore, rotation of the housing 12 about its center line 14 will exert a centrifugal force on the rotor 22 to force it to rotate counterclockwise relative to the housing 12.

Preferably, the rotor 22 is in its armed position when rotation of the rotor 22 ceases. Thus, since rotation of the rotor 22 will cease when the center of gravity 42 assumes its farthest position from the central shell spin axis 14—i.e., when the center of gravity 42 lies along a straight line extending outwardly from the central spin axis 14 through the rotor pivot shaft 26—the detonation communication means 36 is preferably arranged in the rotor 22 directly oppositely from the center of gravity 42 and the rotor pivot shaft 26—i.e., in a straight line with the center of gravity 42 and the pivot shaft 26.

To control the rate of rotation of the rotor 22 relative to the housing 12 to prevent rapid rotation of the rotor 22 which might otherwise permit a premature detonation of the shell, rotation control means 24 are provided within the lower cylindrical section 16 of the housing 12. In the preferred embodiment, this rotation control means 24 comprises a rotatable flywheel 44 having an upwardly extending shaft 46 provided with a series of pins or teeth 48 arranged about its vertical surface. These pins or teeth 48 engage in grooves 50 provided about a portion of the underside of the rotor 22. As best seen in FIGS. 1 and 2, the grooves 50 are arranged on a lower extension 52 which extends below the lower surface 30 of the rotor 22 and are directed inwardly toward the rotor pivot shaft 26. Thus, rotation of the rotor 22 causes corresponding rotation of the fly wheel 44 by indexing of the teeth 48 of the fly wheel shaft 46 in the grooves 50 of the rotor 22. Also, as best seen in FIG. 1, the center of rotation of the fly wheel coincides with the center of rotation of the housing 12 and thus the shell spin axis 14.

Figure 5:
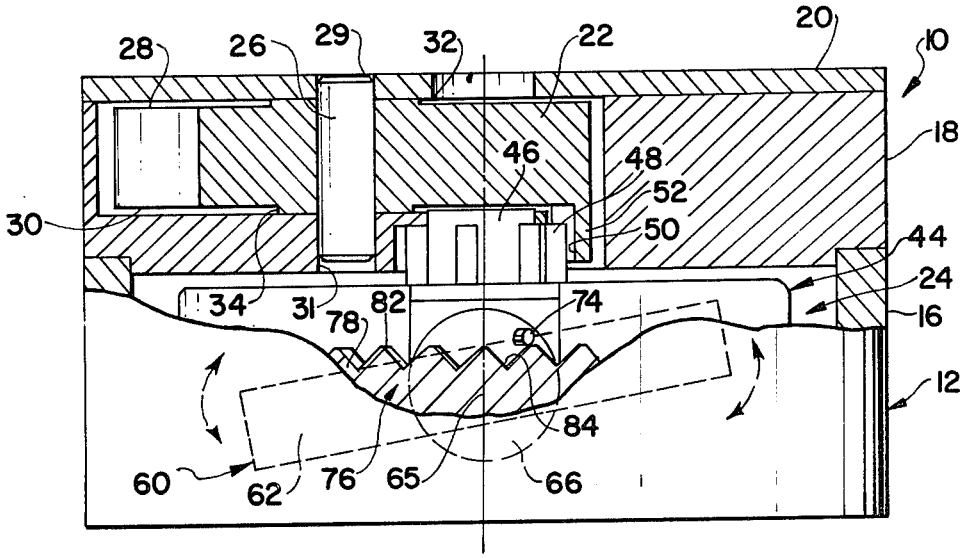
FIG. 5 is a side elevational view, partly in section, of the improved safe and arming device of the present invention, as taken along lines 5—5 of FIG. 2.
Figure 4:
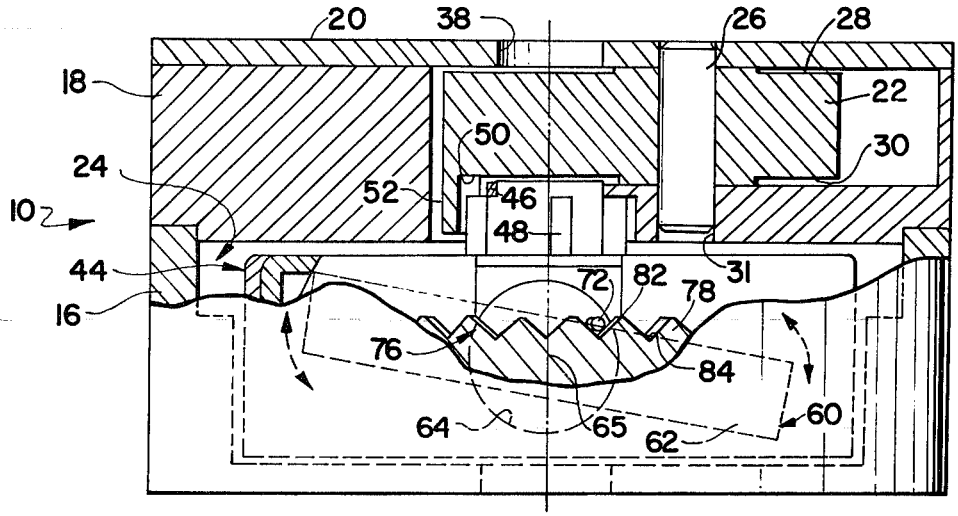
FIG. 4 is a side elevational view, partly in section, of the improved safe and arming device of the present invention, as taken along lines 4—4 of FIG 2.

The fly wheel 44 comprises upper and lower sections or members 54, 56 which are hollowed out therebetween to provide a space for an oscillatory member 60. The oscillatory member 60, in the embodiment shown, comprises a disc shaped member 62 which is pivoted perpendicular to the axis of rotation of the fly wheel 44 (i.e., the central spin axis 14) on a pair of pivot shafts 64, 66 extending from opposite sides of the disc shaped member 62 and journalled in the side walls of the upper and lower fly wheel sections 54, 56. As seen in FIGS. 2, 4 and 5, the diameter of the pivot shafts 64, 66 is greater than the thickness of the disc 62 and the disc 62 is provided with a central opening 68 therethrough for the upwardly extending central shaft 70 of the lower fly wheel section 56. Thus, the oscillator disc 62 may swing or oscillate about the oscillation axis 65 on the pivot shaft 64, 66 within the hollowed out space of the fly wheel 44, as for example, shown in FIGS. 4 and 5.

Camming pins 72, 74 are provided on the pivot shafts 64, 66 respectively, which protrude outwardly therefrom in opposite directions. These camming pins 72, 74 are adapted to ride along the upper surface of a cooperating rack or toothed ring member 76 defined in the hollowed out portion of the lower cylindrical section 16 of the housing 12. The camming pins 72, 74 each are laterally offset above and to opposite sides of the axis 65 of oscillation and are arranged so that the pins 72, 74 alternately engage the teeth 78 of the ring member 76 as the fly wheel 44 rotates within the housing 12. This alternate engagement of one camming pin with the inclined surfaces of the teeth 78 of the ring 76 causes the oscillator disc 62 to oscillate first in one direction (i.e., clockwise) and then in the other direction (i.e., counterclockwise), thereby causing the disc 62 to change momentum. This periodic change in direction (and thus momentum) can best be seen with reference to FIGS. 6–9 which show the cooperating camming action of the pins 72, 74 with ring member 76. The "a" schematic representations in FIGS. 6–9 show the positions of the camming pin 72 on the pivot shaft 64 relative to the ring 76 (as viewed from the right hand side of FIG. 1) and the "b" representations of FIGS. 6–9 show the positions of the opposite pin 74 relative to the ring 76 on the pivot shaft 66 (again as viewed from the right hand side of FIG. 1). Thus, upon rotation of the fly wheel 44 (in a counterclockwise direction as shown in FIG. 1) in the schematic representations of FIGS. 6–9, the camming pin 72 moves to the left relative to the teeth 78, whereas the camming pin 74 moves to the right relative to the teeth 78.

Figures 6A, 6B:
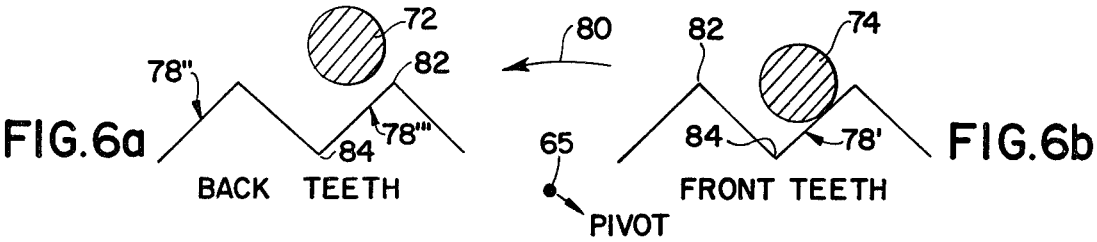
FIGS. 6–9 are schematic representations showing the movement of the pins about the toothed rack and the camming action thereof to cause oscillation of the oscillatory member as viewed from the right hand side of FIG. 1, the "a" representations showing the pin and tooth engagements of the left pin and the "b" representations showing the pin and tooth engagements of the right pin.
Figures 7A, 7B:
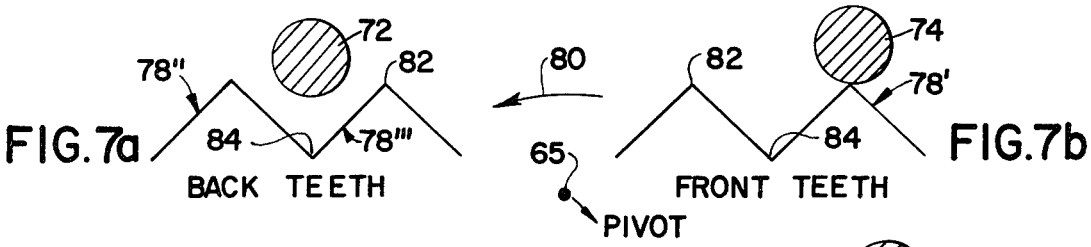
Figures 8A, 8B:
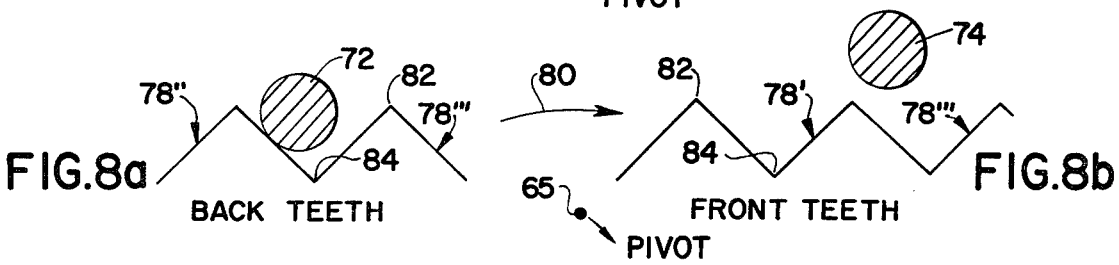
Figures 9A, 9B:
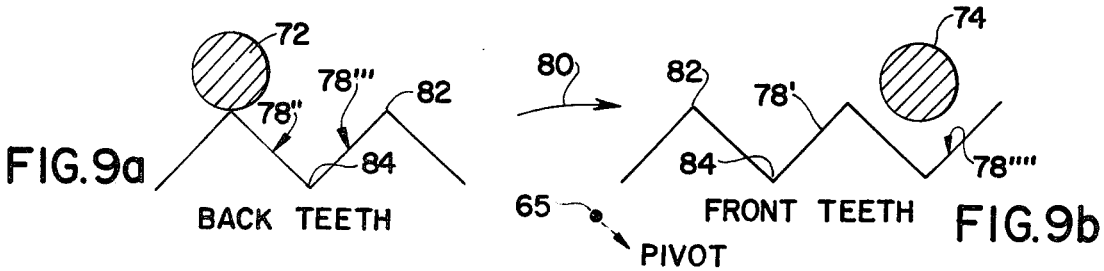

Referring first to FIGS. 6*a* and 6*b*, the camming pin 72 is initially free of the teeth 78 of the ring 76 and the camming pin 74 is initially engaged with the inclined surface of a tooth 78'. During rotation of the fly wheel 44, the camming pin 74 is caused to move upwardly along the inclined surface of the tooth 78', which thereby causes the oscillator disc 62 to rotate in a counterclockwise direction (as shown by arrow 80) about the oscillation axis 65. This counterclockwise movement of the oscillator disc 62 lowers the corresponding camming pin 72 on the other side (FIG. 7) so that the camming pin 72 lies between adjacent teeth 78", 78'". At this position, the camming pin 74 is free of engagement with the teeth 78. Upon continued rotation of the fly wheel 44, the tooth 72 engages the inclined surface of a tooth 78" and is forced upwardly therealong (see FIG. 8). This action is turn reverses the direction of rotation of the oscillator disc 62 so that it rotates in a clockwise direction (as shown by arrow 80) about the oscillation pivot axis 65. Further rotation of the fly wheel 44 causes the camming pin 72 to climb the inclined surface of the tooth 78" while at the same time lowering the corresponding camming pin 74 between adjacent teeth 78', 78''' of the ring 76 (see FIG. 9), until the camming pin 72 is free of engagement with the teeth 78 of the ring 76. Continued rotation of the fly wheel 44 thus causes the pin 74 to engage a tooth 78'''' to begin the oscillatory cycle again.

Thus, it is seen that rotation of the fly wheel 44 in a counterclockwise direction as shown in FIG. 1 can only be accomplished by periodically changing the direction of rotation and thus the momentum of the disc 62. As can be appreciated, such change in direction and momentum necessarily delays or slows down the rate at which the fly wheel 44 can rotate. In other words, this repeated action slows down rotation and prevents a rapid rotation of the fly wheel 44 which in turn prevents a rapid rotation of the rotor 22. Accordingly, while it is the centrifugal force applied to the rotor 22 which exerts a turning moment on the fly wheel 44 and the oscillatory member 60, the rate at which the rotor 22 and fly wheel 44 rotate is controlled by the rate at which the oscillator disc 62 changes direction or momentum.

Further, it is to be noted that during rotation of the fly wheel 44 each of the camming pins 72, 74 on the oscillator pivot shafts 64, 66 is caused to move transversely of the general direction of rotation. That is, the pins 72, 74 are caused to move in and out of an imaginary plane defined between the tips 82 of the teeth 78 and the bottoms of the grooves 84 between teeth 78. This tortuous path which the camming pins 72, 74 must follow also serves as a delay mechanism for controlling the rate of rotation of the fly wheel 44 and thus the rate of rotation of the rotor 22. In essence, for each incremental rotation of the fly wheel 44, the camming pins 72, 74 must travel a relatively greater distance than if the pins 72, 74 were simply allowed to move in the imaginary plane between the tips 82 of the teeth 78 and the bottoms of the grooves 84.

Thus, it is seen that upon firing and rapid rotation of the shell which includes the safe and arming device 10 of the present invention therein, a turning moment is exerted by the rotor 22 to rotate the fly wheel 44. However, the rate of rotation of the rotor 22, and also of the fly wheel 44, is controlled by the inherent delay in the oscillatory member 60 having to periodically change direction and momentum and in the camming pins 72, 74 being caused to move along a tortuous path transversely of the teeth 78 of the ring 76. Thus, the rotor 22 slowly rotates or advances in a counterclockwise manner as shown in FIG. 1 to move toward the armed position in which the detonation communication means 36 will then be in alignment with the central spin axis 14 of the shell. This relatively slow advancement affords sufficient delay so as to prevent detonation of the shell should the fuse detonate prematurely.

During this advancement toward the armed position, the rotor 22 reaches a point where the grooves 50 on the under side of the rotor 22 no longer engage the pins or teeth 48 of the fly wheel shaft 46. At this point, the rotor 22 is free to move independent of the fly wheel 44 and it snaps into its armed position. Once in this position, the device 10 is then capable of transmitting or communicating a detonation signal from the fuse to the main explosive charge of the shell.

As noted hereinabove, the centrifugal force causing the rotor 22 to rotate will cease to cause rotational movement once the center of gravity 42 of the rotor 22 reaches its farthest point from the central spin axis 14. Alternatively however, a positive stop could be provided on the inner surface of the housing 12 which serves to stop rotation of the rotor 22. Of course, if such a stop were provided, the placement of the detonation communication means 36 would have to be changed so that it would be aligned with the central spin axis 14 of the housing 12 when rotation of the rotor 22 is stopped.

Assembly of the safe and arming device 10 of the present invention is accomplished by first assembling the oscillator disc 62 between the upper and lower sections 54, 56 forming the fly wheel 44 and then placing the fly wheel 44 within the lower housing section 16. The upper and lower sections 54, 56 may be joined together in any suitable manner, such as by bolts (not shown). Next, the rotor 22 is mounted within the upper housing section 18 and the upper and lower housing sections 16, 18 and the cover 20 joined together in a suitable manner. As shown in FIG. 1, the rotor 22 is preferably initially positioned with the last groove 50' furthest away from engaging one of the pins or teeth 48 on the fly wheel 44 to provide the longest delay time before detonation is possible. However, if a shorter delay time is desired, one of the pins 48 of the fly wheel 44 could be initially placed in a different groove, in which event the rotor 22 would only have to rotate through a shorter angular distance before reaching its armed position. Although not shown, adjustment means could be provided on the rotor 22 for changing the angular orientation of the rotor 22 relative to the housing 12 to provide adjustment of the position of the rotor 22 without having to completely disassemble the housing 12.

Thus, it is seen that the improved safe and arming device 10 of the present invention provides a simple and efficient means for preventing premature detonation of explosive projectiles. All of the component parts of the device 10 are easily manufactured and assembled. In particular, the improved safe and arming device of the present invention does not require the manufacture of small finely detailed pinions which have in the past been both expensive and required complicated assembly procedures and techniques.

This disadvantage of the prior art is overcome with the present invention which requires that the direction, and thus momentum, of an oscillatory member 60 be periodically changed in order to permit rotation of a rotation control member or fly wheel 44. The rate of change of the momentum thus controls the rate of rotation of the fly wheel 44 to control the rate at which the safe and arming device 10 will become armed. In addition, the camming pins 72, 74 carried by the oscillatory member 60 are caused to move along a tortuous path in and out of a plane defined by the circular path of the fly wheel 44. This action also serves to control the rate of rotation of the fly wheel 44.

While the preferred embodiment of the present invention has been shown and described, it will be understood that such is merely illustrative and that changes may be made without departing from the scope of the invention as claimed.

What is claimed is:

1. An improved safe and arming device for isolating a fuse from a main explosive charge in spin stabilized shells to prevent premature detonation of such shells, the improved safe and arming device comprising:

a housing adapted to be positioned intermediate of the fuse and the main explosive charge of such shells for rotation therewith about a shell spin axis when the shells are fired;

a rotor mounted in said housing for rotation about a rotor axis extending in a first direction, said rotor having detonation communication means for communicating a detonation signal from said fuse to said explosive charge only when said rotor is in an armed position, said rotor being positionable in a desired start position displaced from said armed position, said rotor being adapted to rotate from said start position to said armed position in response to rotation of said shell; and rotation control means for controlling the rate of rotation of said rotor from said start position to said armed position, said rotation control means comprising:

a rotatable member engageable with said rotor for controlling the rate of rotation of said rotor, rotation of said rotatable member defining a circular path;

a delay member carried by said rotatable member for controlling the rate of rotation of said rotatable member; and means for causing said delay member to follow a tortuous path as said rotatable member rotates which carries said delay member in and out of the plane of said circular path defined by rotation of said rotatable member.

2. The improved safe and arming device of claim 1 wherein said armed position of said rotor is a rest position of said rotor in which said rotor does not rotate in response to rotation of said shell.

3. The improved safe and arming device of claim 2 wherein said rotor is a nonsymmetrical rotor having a center of gravity displaced from said rotor axis, and wherein when said rotor is in said armed position, the center of gravity of said rotor is located at a maximum distance from said shell spin axis.

4. The improved safe and arming device of claim 1 wherein said rotatable member engages said rotor only during a portion of the rotation of said rotor from said start position to said armed position.

5. The improved safe and arming device of claim 4 wherein said rotatable member engages said rotor during rotation of said rotor from said start position to an intermediate position and wherein said rotor is free to rotate in response to rotation of said shell from said intermediate position to said armed position.

6. The improved safe and arming device of claim 1 wherein said delay member comprises at least one pin and wherein said means for causing said delay member to follow a tortuous path comprises a cooperating rack member having a plurality of teeth for said at least one pin in which said pin is caused to move transverse to the plane of said rack member as it follows the contour of said teeth of said rack member.

7. The improved safe and arming device of claim 6 wherein said rotatable member carries a second pin, said second pin being arranged with respect to said at least one pin such that when said one pin is at the tip of one of said teeth of said cooperating rack, said second pin is between adjacent teeth of said cooperating rack.

8. The improved safe and arming device of claim 7 wherein the axis of rotation of said rotatable member extends in said first direction; wherein said rotatable member includes an oscillatory member supported for oscillatory motion about an oscillation axis extending in a second direction transverse to said first direction, and wherein said one pin and said second pin are affixed to said oscillatory member to extend in said second direction so that the momentum of said osillatory member is caused to change as said one pin and said second pin follow the contour of said teeth of said cooperating rack member as said rotatable member rotates.

9. The improved safe and arming device of claim 8 wherein said cooperating rack member comprises a circular ring supported within said housing and having said teeth extending in said first direction; and wherein said one pin and said second pin are affixed to said oscillatory member to extend from opposite sides thereof and are laterally offset from said oscillation axis.

10. An improved safe and arming device for isolating a fuse from a main explosive charge in spin stabilized shells to prevent premature detonation of such shells, the improved safe and arming device comprising:

a housing adapted to be positioned intermediate of the fuse and the main explosive charge of such shells for rotation therewith about a shell spin axis when the shells are fired;

a rotor mounted in said housing for rotation about a rotor axis extending in the same direction as said shell spin axis, said rotor having detonation communication means for communicating a detonation signal from said fuse to said explosive charge only when said rotor is in an armed position, said rotor being positionable in a desired start position displaced from said armed position, and said rotor being adapted to rotate from said start position to said armed position in response to rotation of said shell; and rotation control means for controlling the rate of rotation of said rotor from said start positin to said armed position, said rotation control means comprising:

a rotatable member engageable with said rotor for controlling the rate of rotation of said rotor, said rotatable member being rotatable about an axis extending in the same direction as said shell spin axis;

an oscillatory member supported by said rotatable member for oscillatory motion in two directions; and oscillation causing means responsive to rotation of said rotatable member for causing said oscillatory member to periodically move in one of said two directions, and then in the other of said two directions to thereby periodically change the momentum of said oscillatory member, the periodic rate of change of momentum of said oscillatory member thereby controlling the rate of rotation of said rotatable member.

11. The improved safe and arming device of claim 10 wherein said armed position of said rotor is a rest position of said rotor in which said rotor does not rotate in response to rotation of said shell.

12. The improved safe and arming device of claim 11 wherein said rotor is a nonsymmetrical rotor having a center of gravity displaced from said rotor axis, and wherein when said rotor is in said armed position, the center of gravity of said rotor is located at a maximum distance from said shell spin axis.

13. The improved safe and arming device of claim 10 wherein said rotatable member engages said rotor only during a portion of the rotation of said rotor from said start position to said armed position.

14. The improved safe and arming device of claim 13 wherein said rotatable member engages said rotor during rotation of said rotor from said start position to an intermediate position and wherein said rotor is free to rotate in response to rotation of said shell from said intermediate position to said armed position.

15. The improved safe and arming device of claim 10 wherein said oscillatory member is supported by said rotatable member for rotational oscillatory motion in two directions about an oscillation axis extending in a direction transverse to the direction of said shell spin axis, and wherein said oscillation causing means causes said oscillatory member to periodically rotate clockwise about said oscillation axis and then rotate counterclockwise about said oscillation axis to thereby periodically change the momentum of said oscillatory member.

16. The improved safe and arming device of claim 15 wherein said oscillation causing means comprises a rack member disposed in said housing and having a plurality of teeth, and first and second pins affixed to said oscillatory member and engageable with said teeth of said rack member to follow the contour of said teeth in response to rotation of said rotatable member to cause said oscillatory member to periodically change momentum.

17. The improved safe and arming device of claim 16 wherein said first and second pins are affixed to said oscillatory member to extend from opposite side thereof and are laterally offset from said oscillation axis to alternatively engage said teeth of said rack member in response to rotation of said rotatable member to cause said oscillatory member to periodically change momentum.

18. The improved safe and arming device of claim 17 wherein said first and second pins are arranged with respect to one another such that when one of said pins is at the tip of one of said teeth of said rack member, the other of said pins is between adjacent teeth of said rack member.

* * * * *